United States Patent [19]

Graves

[11] Patent Number: 4,773,639

[45] Date of Patent: Sep. 27, 1988

[54] INFANT WALKER

[76] Inventor: Kurt M. Graves, 421 Capital Dr., Avondale, La. 70094

[21] Appl. No.: 51,205

[22] Filed: May 13, 1987

Related U.S. Application Data

[63] Continuation of Ser. No. 767,751, Aug. 21, 1985, abandoned.

[51] Int. Cl.[4] ..... A63C 3/04

[52] U.S. Cl. ..... 272/70.3; 297/5

[58] Field of Search ..... 272/70, 70.3, 70.4, 272/112, 113, 144; 135/67; 297/5; 248/188.7; 280/87.02 W

[56] References Cited

U.S. PATENT DOCUMENTS

| | | | |
|---|---|---|---|
| 153,827 | 8/1874 | Holman | 297/5 |
| 321,867 | 7/1885 | Van Vleck | 272/70.4 |
| 1,176,048 | 3/1916 | Gentilella | 272/70.3 |
| 2,657,735 | 11/1953 | Hughes | 297/5 |
| 2,884,046 | 4/1959 | Patrick | 297/5 |
| 3,235,254 | 2/1966 | Robson | 272/70.3 |
| 3,466,031 | 9/1969 | Boykin, Jr. | 272/65 |
| 4,021,033 | 5/1977 | Auclair et al. | 272/70.3 |
| 4,197,685 | 4/1980 | Goulish et al. | 248/188.7 X |
| 4,262,901 | 4/1981 | Faust | 272/144 |
| 4,274,687 | 6/1981 | Bayles et al. | 248/188.7 X |

FOREIGN PATENT DOCUMENTS

| | | | |
|---|---|---|---|
| 439787 | 9/1948 | Italy | 272/70.3 |

*Primary Examiner*—Richard J. Apley
*Assistant Examiner*—J. Welsh
*Attorney, Agent, or Firm*—Pravel, Gambrell, Hewitt, Kimball & Krieger

[57] ABSTRACT

A walker for use by infants in learning to walk includes a pair of spaced apart closed ring structures that are supported apart by a plurality of inwardly inclined adjustable struts. The rings are of a variable diameter with the lower ring defining a base substantially larger than the upper ring. The upper ring is sized to substantially fit the torso of the infant so as to confine the infant and prevent the infant from falling. The lower, larger ring provides an enlarged base which prevents the apparatus from tipping during use. The infant grips the upper ring during use. The adjustable struts allow adjustment between the upper and lower rings so that the device can be sized to fit each user of different height.

1 Claim, 1 Drawing Sheet

INFANT WALKER

This is a continuation of co-pending application Ser. No. 767,751 filed on Aug. 21, 1985, now abandoned.

GENERAL BACKGROUND

1. Field Of The Invention

The present invention relates to walkers or devices for the training of infants learning to walk. Even more particularly the present invention relates to an improved, safe walker for training small infants to walk wherein a large base of rectangular or square configuration is connected to an upper spaced apart second ring of much smaller diameter which confines the torso of the infant). The two rings are connected by inclined adjustable struts.

There are a number of devices which relate to the training of the infant to walk. Various commercially available walkers for infants include the "Tot Wheels" baby walker from Graco Children's Products, Inc., of Elverson, Pa., the "Wonder Walker" also sold by Graco, and the "Fun-A-Round" manufactured by Strolee Corporation of Rancho Dominquez, Calif. Additional models includes the "Star Coupe Walker" manufactured Century Products. Many of these devices are wheeled, having a seat which the infant sit upon. Some of the devices allow the infant to stand and walk as an alternative means of moving the device about. Unfortunately, the wheeled devices can be quite dangerous, because the infant can move rapidly across a surface such as a floor by pushing against the ground rather than by walking. These devices are hazardous because an infant can quickly propel the device toward a stairway for example before an adult can stop an accident. Further, such wheeled devices discourage the infant from moving about by walking. Rather the infant merely pushes against the ground with his foot while assuming a sitting position in order to propel himself about the house.

The present invention provides an improved training device for infants, which allows the child to sit but which encourages the infant to walk so that he does move the device across the floor unless he in fact is walking with it. The apparatus includes a pair of spaced apart rings including a lower ring which is large and an upper ring which is smaller. The upper ring is sized slightly larger in cross-sectional dimension and the torso of the infant. The lower ring is much larger, having a cross-sectional dimension of approximately twice that of the upper ring. A plurality of inwardly inclined struts connect the upper and lower rings so that the upper ring is positioned concentrically within the lower ring, but in an elevational plane above the plane defined by the lower ring. In the preferred embodiment of the invention both rings are square, however, other ring configurations could be provided. The upper ring includes a small diameter cross-section which can be easily gripped by the infant such as during walking with the device.

BRIEF DESCRIPTION OF THE DRAWINGS

FIG. 1 and 2 best illustrate the preferred embodiment of the apparatus of the present invention generally by the numeral 10.

DETAILED DESCRIPTION OF THE PREFERRED EMBODIMENT

Walker 10 is preferably used in the training of infants and includes a pair of spaced apart rings 12, 14 which are preferably square. The upper ring is approximately one-half the cross-sectional width of the lower ring 12. Thus, for example, the upper ring could be approximately 12–18 inches in width, while the lower ring would be approximately 24–36" across. The dimension of bottom ring could be larger than a door width to prevent a child from leaving a particular room if desired.

Rings 12, 14 are positioned in planes 13, 15 which are parallel. Further, the smaller ring 14 is concentrically placed with respect to the lower ring 12. A plurality of struts 16–19 form connections between upper ring 14 and lower ring 12.

Figure 1:
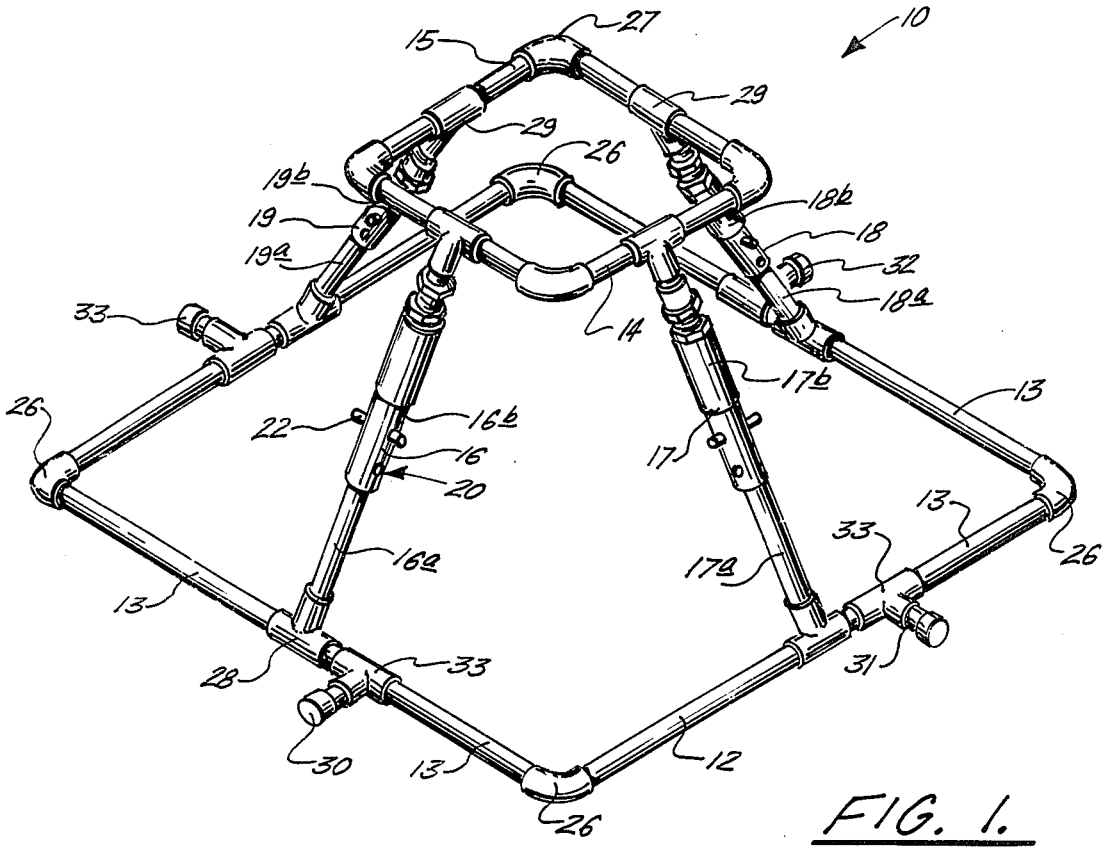
FIG. 1 is a perspective view of the preferred embodiment of the apparatus of the present invention.
Figure 2:
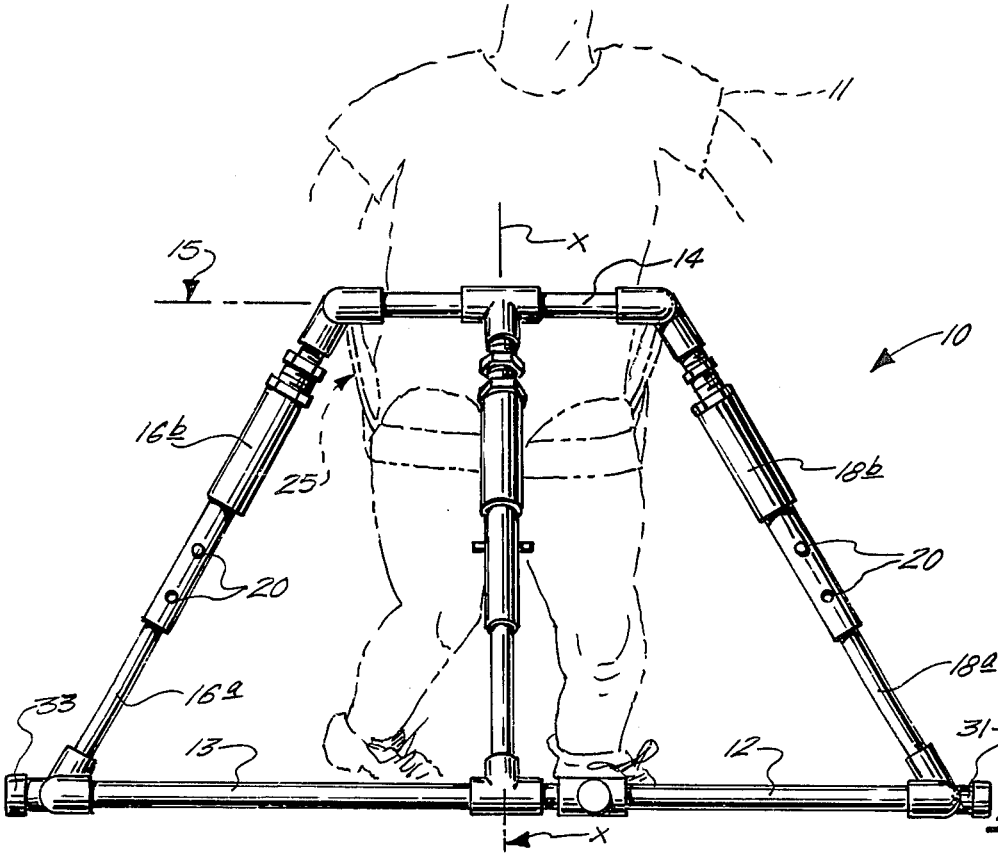
FIG. 2 is a side of the preferred embodiment of the apparatus of the present invention.

Each strut is adjustable having telescoping sections including lower diameter sections 16A–19A and larger upper sections 16B–19B. Each upper section 16B–19B includes a plurality of openings, designated by the numeral 20 in the drawings. Multiple openings 20 could be provided on each strut upper section 16B–19B. A transverse peg can 22 be inserted through opening 20 at a corresponding opening (not shown) in lower section 16A–19A. Thus, the insertion of transverse peg 22 locks a particular strut and fixes its length. This provides an adjustability of the distance between lower ring 12 and upper ring 14 so that the device can be adjusted for a particular infant as the child grows. In FIG. 2 the infant is designated in phantom lines by the numeral 11. A seat portion 25 is also shown in phantom lines in FIG. 2. The seat could be for example made of fabric, plastic mesh or the like. The seat could be positioned from side to side so that the infant would sit upon it or the infant could straddled the seat 25 so that when the infant sat down he would not be able to slip completely to the floor, either embodiment of seat 25 could be used with the present invention. Further, the seat could be of a disconnect construction using buttons, grips or the like so that the seat could be removed for cleaning and replaced. As the infant grows, the seat construction could be changed to allow for more mobility and less constriction. Smaller infants could have a seat of more confining construction which would be safer.

Lower ring 12 includes a plurality of elongated tubular sections 13 each of which could be hollow for the purposes of saving weight. In the preferred embodiment, the tubular sections 13 would be for example hollow plastic tubing. Further, ring 12 would include elbow sections 26 which would connect the tubes 13 at their end portions. The inner section of each strut 16, 19 with ring 12 and with ring 14 provides a T section 28 which likewise could be manufactured of injection molded plastic or the like.

Similarly, upper ring 14 provides multiple tubular sections 15 which are connected at their ends by elbows 27 of injection molded plastic for example. Struts 16–19 similarly connect to upper ring 14 with a plurality of T's 29 as shown in the drawings.

As an added stability feature, the lower ring provides preferably four laterally extending feet 30–33 each foot 30–33 is connected to lower ring 12 adjacent Tee 28 which is the connection of the lower ring 12 to each particular strut 16–19. The feet 30, 33 would be connected to tubing 13 by means of a Tee member 33 for example.

It should be understood that the entire apparatus 10 could be manufactured of single injection molded piece using plastic if a mold were manufactured in the configuration of the entire device. In the preferred embodiment, however, the apparatus would be connected of the parts and sections as described so that it could be sold in a collapsed state thus, compacted for transportation purposes.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limited sense.

What is claimed is:

1. An infant walker comprising:

a. a pair of spaced apart squared rings, each having four corners, including an upper smaller ring that closely approximates a position adjacent the torso of an infant and a lower larger ring, each respectively lying in parallel spaced apart planes;

b. a plurality of angled struts extending outwardly and downwardly from the upper ring at a position generally between adjacent corners of the upper ring and connecting to the lower ring at a position generally between adjacent corners of the lower ring each of the angled struts being inclined between the upper and lower rings along a generally straight line;

c. means for adjusting the length of each angled strut to vary the elevation between the rings;

d. the lower squared ring forming a continuous ground contacting surface which can slide upon and form an interface with the supporting terrain being traversed by the infant; and e. means for discouraging a tipping of the upper ring with respect to the lower ring and a corresponding tilting of the vertical axis of the walker trainer, comprising the four lower corners and a plurality of four radially spaced apart horizontal struts extending in a substantially straight line outwardly from the lower squared ring, terminating at horizontal strut free ends, the horizontal struts being positioned at four respective positions generally between adjacent corners of the lower squared ring and the horizontal struts each lying in a horizontal plane therewith, and the horizontal struts being adapted and positioned to slide with the lower ring, the free ends of the horizontal struts and the lower ring corners defining the outer dimensional limits of the support plane area that is larger than the area encompassed by the lower squared ring.

* * * * *